US008145105B2

(12) United States Patent
Ueda et al.

(10) Patent No.: US 8,145,105 B2
(45) Date of Patent: Mar. 27, 2012

(54) BELT DRIVE CONTROL DEVICE, BELT DEVICE, IMAGE FORMING APPARATUS, AND BELT DRIVE CONTROL METHOD

(75) Inventors: Yuichiro Ueda, Zama (JP); Kazuhiko Kobayashi, Tokyo (JP); Takuya Uehara, Tokyo (JP); Takuya Murata, Tokyo (JP); Yuji Matsuda, Inagi (JP); Takahiro Kamekura, Kawasaki (JP); Toshiyuki Andoh, Sagamihara (JP); Hiromichi Matsuda, Isehara (JP); Hiroki Ohkubo, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 467 days.

(21) Appl. No.: 12/406,435

(22) Filed: Mar. 18, 2009

(65) Prior Publication Data

US 2009/0238613 A1 Sep. 24, 2009

(30) Foreign Application Priority Data

Mar. 18, 2008 (JP) ..... 2008-069662

(51) Int. Cl.
*G03G 15/00* (2006.01)

(52) U.S. Cl. ..... 399/301

(58) Field of Classification Search ..... 399/301
See application file for complete search history.

(56) References Cited

U.S. PATENT DOCUMENTS 7,386,262 B2 6/2008 Okamura et al.

FOREIGN PATENT DOCUMENTS

| | | |
|---|---|---|
| JP | 2754582 | 3/1998 |
| JP | 2002-72816 | 3/2002 |
| JP | 2004-21236 | 1/2004 |
| JP | 2006-23403 | 1/2006 |
| JP | 2006-106642 | 4/2006 |

*Primary Examiner* — Quana M Grainger

(74) *Attorney, Agent, or Firm* — Oblon, Spivak, McClelland, Maier & Neustadt, L.L.P.

(57) ABSTRACT

A belt drive control device includes: first and second detection devices which detect the angular displacement or velocity of a driven rotary member and the angular displacement or velocity of a drive rotary member, respectively; an extraction device which extracts, from the difference between the detection results of the first and second detection devices, the amplitude and phase of a variation component due to belt thickness variation; a control device which controls the rotation of the drive rotary member in accordance with the extracted amplitude and phase; first and second holding devices which hold the extracted amplitude and phase and normal ranges of the amplitude and phase, respectively; and first and second feedback devices which feed back the amplitude and phase to the rotation control, and performs feedback by using a substitution value for the amplitude or phase if the amplitude or phase is out of the normal range, respectively.

4 Claims, 7 Drawing Sheets

BELT DRIVE CONTROL DEVICE, BELT DEVICE, IMAGE FORMING APPARATUS, AND BELT DRIVE CONTROL METHOD

CROSS-REFERENCE TO RELATED APPLICATION

The present invention claims priority pursuant to 35 U.S.C. §119 from Japanese Patent Application No. 2008-069662, filed on Mar. 18, 2008 in the Japan Patent Office, the contents and disclosures of which are hereby incorporated by reference herein in their entirety.

BACKGROUND OF THE INVENTION

1. Field of the Invention

The present invention relates to a belt drive control device which performs drive control of a belt stretched over a plurality of supporting rotary members, a belt device using the belt drive control device, an image forming apparatus, such as a copier, a printer, a facsimile machine, and a digital multifunctional machine having the functions of these apparatuses, which uses the belt device, and a belt drive control method for the belt drive control drive.

2. Discussion of the Background Art

As an example of an apparatus using a belt, an image forming apparatus using a belt, such as a photoconductor belt, an intermediate transfer belt, and a sheet conveying belt, is known. In such an image forming apparatus, highly accurate drive control of the belt is necessary to obtain a high-quality image.

Next, a description is given of an example of a related-art tandem-type electrophotographic image forming apparatus using an intermediate transfer method will now be described.

The related-art image forming apparatus includes an intermediate transfer belt, image forming units, a laser exposure unit, a fixing device, photoconductor drums, and so forth. In the image forming apparatus, the image forming units are sequentially arranged in the conveying direction of a recording sheet (i.e., a recording medium) to form single-color images of yellow (Y), magenta (M), cyan (C), and black (K), for example. The laser exposure unit forms electrostatic latent images on the surfaces of the photoconductor drums. The electrostatic latent images are then developed in the image forming units to form toner images (i.e., visible images). Then, the respective single-color images formed on the surfaces of the photoconductor drums in the image forming units are transferred onto the intermediate transfer belt such that the images are superimposed on one another. Thereafter, toner in the toner images is fusion-pressed and fixed onto the recording sheet by the fixing device to form a color image on the recording sheet.

In this type of image forming apparatus, a phenomenon known as color shift occurs if the moving speed of the recording sheet, i.e., the moving speed of the intermediate transfer belt, is not kept constant. The color shift is caused by a relative shift in the transfer position of the single-color images superimposed on the recording sheet. The color shift results in, for example, the blurring of a fine line image formed by superimposed images of a plurality of colors, and the formation of white spots around the outline of a black text image appearing in a background image formed by superimposed images of a plurality of colors.

Further, in the above-described related-art tandem-type image forming apparatus, and also in an image forming apparatus which uses a belt as a recording medium conveying member for conveying a recording medium or as an image carrying member for carrying an image to be transferred onto the recording medium, such as a photoconductor and an intermediate transfer member, banding occurs if the moving speed of the belt is not kept constant. Here, banding refers to unevenness in image density caused by variation in the belt moving speed in an image transfer process.

That is, an image portion transferred at a relatively high belt moving speed has a shape expanded in the circumferential direction of the belt, as compared with the original shape of the image portion. Conversely, an image portion transferred at a relatively low belt moving speed has a shape contracted in the circumferential direction of the belt, as compared with the original shape of the image portion. Accordingly, the density is reduced in the expanded image portion and increased in the contracted image portion.

As a result, the image density becomes uneven in the circumferential direction of the belt, and the banding occurs. The banding is clearly perceivable by the human eye, if the formed image is of a single pale color.

As described above, it is necessary for preventing the color shift and the banding to perform highly accurate drive control of a circular belt, such as a photoconductor belt, an intermediate transfer belt, and a conveying belt, for moving the belt at a constant moving speed. To provide such highly accurate drive control of a belt, a background drive control method controls the rotation of a drive roller to maintain a constant rotational speed of the drive roller which drives the belt. According to the drive control method, the rotational angular velocity of a motor which serves as a drive source and the rotational angular velocity of a gear which transmits torque generated by the motor to the drive roller are kept constant to maintain a constant rotational speed of the drive roller.

According to the above-described belt drive control method, however, if the thickness of the belt varies particularly in the moving direction of the belt, it is difficult to maintain a constant moving speed of the belt, even if the rotational angular velocity of the drive roller is kept constant.

Known image forming apparatuses addressing the above-described issue include, for example, the five background image forming apparatuses described below.

A first background image forming apparatus controls the rotation of the drive roller as follows: In order to highly accurately extract the amplitude and the phase of an alternating current component corresponding to a variation in thickness of the belt in the circumferential direction thereof using a less expensive arithmetic processing device than a device for performing the Fourier transform, an encoder rotation detection unit detects the angular displacement or the angular velocity of a driven roller. Then, on the basis of the detection result, a belt cycle variation detection unit performs quadrature detection to extract the amplitude and the phase of a belt alternating current component of an angular displacement or an angular velocity having a frequency corresponding to the variation in thickness of the belt. On the basis of the thus-extracted amplitude and phase, a target function calculation unit generates a target function. Further, on the basis of the target function, a target reference signal generation unit generates a target reference signal. Then, a comparator compares the target reference signal with an FB signal representing the detection result of the encoder rotation detection unit. On the basis of the comparison result, a motor is controlled. Thereby, the rotation of the drive roller is controlled.

According to a second background image forming apparatus, a drive signal output by a motor and input to a conversion unit is converted into the rotational angular velocity of a driven roller to enable an image forming operation to be performed even during the extraction of the amplitude and the phase of a belt alternating current component of a rotational angular displacement or a rotational angular velocity having a frequency corresponding to a periodical variation in thickness of the belt in the circumferential direction thereof. Then, a comparator compares an output drive signal with the input drive signal converted by the conversion unit to obtain a variation component attributed to a belt thickness variation in one belt cycle. A cycle variation sampling unit then stores in a memory the variation component attributed to the belt thickness variation in one belt cycle. Then, on the basis of the variation component for one belt cycle stored in the memory, a variation amplitude and phase detection unit detects the amplitude and the phase of the belt cycle variation component.

To prevent irregular rotation of a rotary member, a third background image forming apparatus, which is a color image forming apparatus, includes a drive device, a first speed detection device, a second speed detection device, a Fourier transform device, a correction data calculation device, a correction data storage device, and a drive control device. The drive device drives to rotate the rotary member. The first speed detection device outputs a signal having a frequency proportional to the rotational speed of the drive device. The second speed detection device outputs a signal having a frequency proportional to the rotational speed of the rotary member. The Fourier transform device performs Fourier transform processing on the signal output by the second speed detection device. The correction data calculation device extracts a specific frequency component to be corrected, and calculates and generates correction data from the frequency and the amplitude of the frequency component. The correction data storage device stores the correction data calculated by the correction data calculation device. The drive control device controls the rotational speed of the drive device on the basis of the respective detection signals output by the first and second speed detection devices and the correction data read from the correction data storage device.

A fourth background image forming apparatus, which is a color image forming apparatus, is designed to reduce a positional shift and expansion and contraction of an image in a transfer operation, without substantially increasing the mechanical accuracy of the apparatus. The color image forming apparatus includes a transfer member used to transfer a toner image formed on a photoconductor onto a recording sheet, and a drive shaft used to rotate the transfer member. A storage device previously stores the information of a change in the angular velocity of the drive shaft occurring when a drive motor for driving the transfer member is rotated at a constant angular velocity. Then, the transfer operation is performed while the information of the change in the angular velocity is read from the storage device and the angular velocity of the drive motor is changed on the basis of the information.

A fifth background image forming apparatus prevents the color shift in the transferred image attributable to the variation in the moving speed of the intermediate transfer belt or the like, due to such factors as an unclear mark and a scratch on the belt. The image forming apparatus detects the moving speed of the circular belt, which carries a recording sheet or a toner image and is provided with marks at predetermined intervals, and controls the moving speed to be constant to control the shift in the transfer position of the toner image transferred onto the recording sheet or the circular belt. The image forming apparatus includes a device which detects the moving speed of a mark, a device which calculates and acquires, on the basis of the moving speed, the extend of adjustment, if any, in the speed of the belt to obtain a previously set target speed, and a device which controls the belt speed with the thus-acquired speed adjustment until the next mark. If there is an unclear mark, control based on the previous mark is maintained to keep the speed constant. Further, if there is a stain or scratch, the calculation and acquisition of the speed adjustment is not performed, and speed adjustment based on the previous mark is maintained to keep the speed constant.

The first four background image forming apparatuses are similar in that they attempt to prevent the color shift in an image by controlling the rotational speed of the drive device. However, in the above background image forming apparatuses, abnormal control data detected due to a noise factor such as vibration, for example, may be used in a feedback operation, adversely affecting control performance. A method for preventing such deterioration of the control performance is not proposed.

Meanwhile, the fifth background image forming apparatus performs adjustment of the transfer position of an image, which is different from the belt drive control.

SUMMARY OF THE INVENTION

This patent specification describes a belt drive control device, a belt device, an image forming apparatus, and a belt drive control method.

In one example, a belt drive control device includes a first detection device, a second detection device, an extraction device, a control device, a first holding device, a first feedback device, a second holding device, and a second feedback device. The first detection device is configured to detect one of rotational angular displacement and rotational angular velocity of a driven supporting rotary member included in a plurality of supporting rotary members over which a circular belt is extended and not contributing to transmission of torque. The second detection device is configured to detect one of the rotational angular displacement and the rotational angular velocity of a drive supporting rotary member included in the plurality of supporting rotary members and receiving the torque from a drive source. The extraction device is configured to extract, from a difference between a detection result of the first detection device and a detection result of the second detection device, amplitude and phase of a belt alternating current component of one of a rotational angular displacement and a rotational angular velocity having a frequency corresponding to a cyclical variation in thickness of the belt. The control device is configured to control the driving of the belt by controlling the rotation of the drive supporting rotary member based on the amplitude and the phase of the belt alternating current component extracted by the extraction device. The first holding device is configured to hold the amplitude and the phase extracted by the extraction device. The first feedback device is configured to feed back the amplitude and the phase held by the first holding device to rotation control of the drive supporting rotary member. The second holding device is configured to set and hold respective normal ranges of the amplitude and the phase. The second feedback device is configured to perform, if any of the amplitude and the phase is out of the normal range thereof, a feedback operation using a substitution value substituted for the any of the amplitude and phase fed back by the first feedback device.

Further, in one example, a belt device includes the above-described belt drive control device, a belt drive device, and a circular belt. The belt drive device is configured to be controlled by the belt drive control device. The circular belt is configured to be driven by the belt drive device.

Further, in one example, an image forming apparatus includes the above-described belt device and an image forming device to form an image on the belt and transfer the image onto a recording medium.

Further, in one example, an image forming apparatus includes the above-described belt device and an image forming device configured to form an image on a recording medium conveyed by the belt.

Further, in one example, a belt drive control method for a belt drive control device includes a first detection step, a second detection step, an extraction step, a control step, a first holding step, a first feedback step, a second holding step, and a second feedback step. The first detection step detects one of rotational angular displacement and rotational angular velocity of a driven supporting rotary member included in a plurality of supporting rotary members over which a circular belt is extended and not contributing to transmission of torque. The second detection step detects one of the rotational angular displacement and the rotational angular velocity of a drive supporting rotary member included in the plurality of supporting rotary members and receiving the torque from a drive source. The extraction step extracts, from a difference between a detection result of the first detection step and a detection result of the second detection step, amplitude and phase of a belt alternating current component of one of a rotational angular displacement and a rotational angular velocity having a frequency corresponding to a cyclical variation in thickness of the belt. The control step controls the rotation of the drive supporting rotary member based on the amplitude and the phase of the belt alternating current component extracted in the extraction step. The first holding step holds the amplitude and the phase extracted in the extraction step. The first feedback step feeds back the amplitude and the phase held in the first holding step to rotation control of the drive supporting rotary member. The second holding step holds respective normal ranges of the amplitude and the phase. The second feedback step performs, if any of the amplitude and the phase is out of the normal range thereof, a feedback operation using a substitution value substituted for the any of the amplitude and the phase fed back in the first feedback step.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
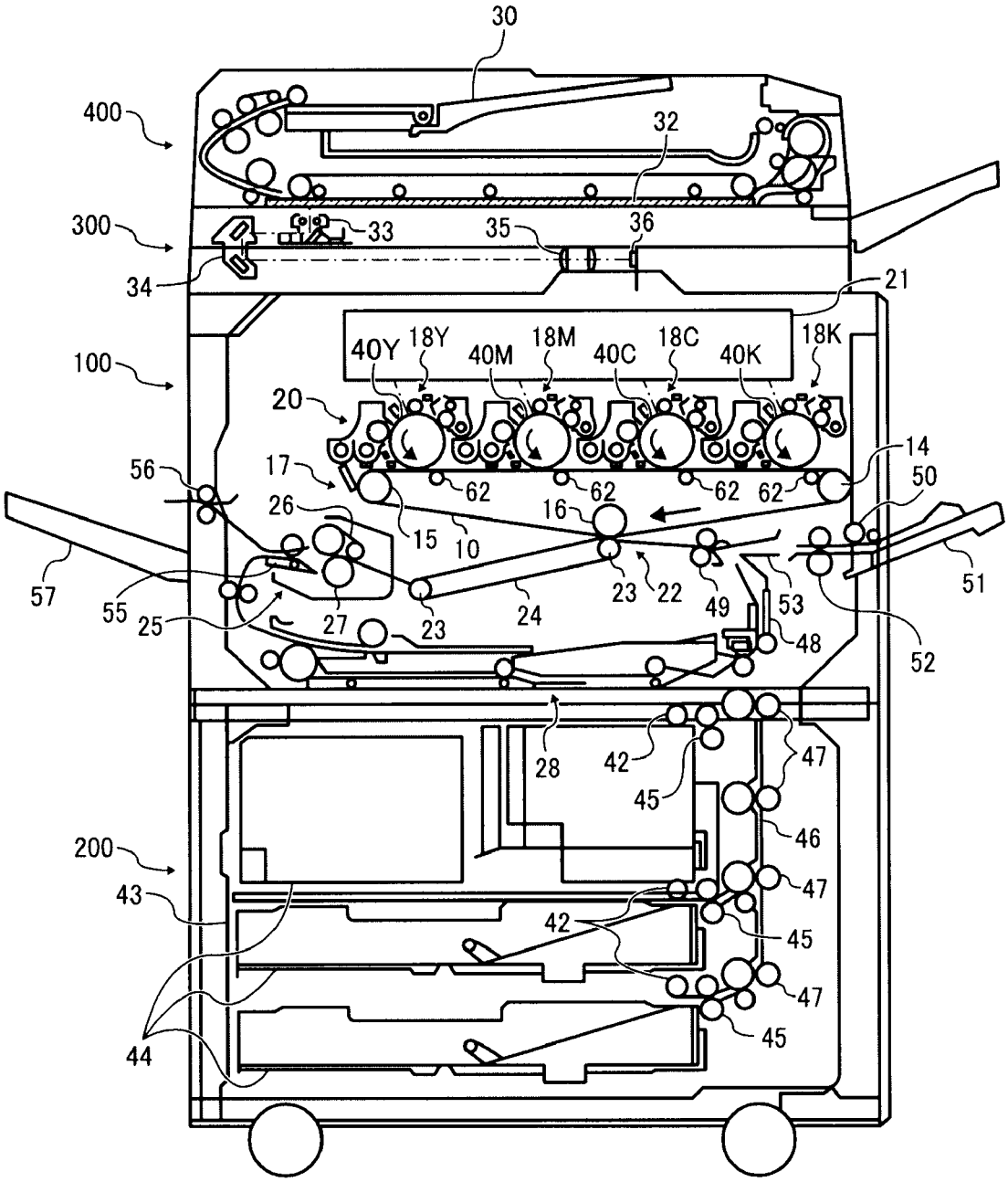
FIG. 1 is a diagram illustrating a schematic structure of a tandem-type image forming apparatus.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, particularly to FIG. 1, an embodiment of the present invention will be described. FIG. 1 is a schematic diagram illustrating a configuration of a copier as an image forming apparatus according to an embodiment of the present invention. The present copier is a tandem-type electrophotographic copier according to an intermediate transfer (i.e., indirect transfer) method. In FIG. 1, the copier includes a copier body 100, a sheet feeding table 200 on which the copier body 100 is placed, a scanner 300 installed on the copier body 100, and an automatic document feeder (hereinafter referred to as the ADF) installed on the scanner 300.

The copier body 100 includes an intermediate transfer belt 10, first to third supporting rollers 14, 15, and 16, an intermediate transfer belt cleaning device 17, a tandem-type image forming unit 20 including four image forming units 18Y, 18M, 18C, and 18K which include photoconductor drums 40Y, 40M, 40C, and 40K, respectively, an exposure device 21, a second transfer device 22 including rollers two 23 and a second transfer belt 24, a fixing device 25 including a fixing belt 26 and a pressure roller 27, a sheet reversing device 28, a sheet feeding path 48, a registration roller 49, a sheet feeding roller 50, a manual sheet feeding tray 51, a separation roller 52, a manual sheet feeding path 53, a switching claw 55, a discharging roller 56, a sheet discharging tray 57, and rollers 62.

The sheet feeding table 200 includes sheet feeding rollers 42, a sheet bank 43, a plurality of sheet feeding cassettes 44, separation rollers 45, a sheet feeding path 46, and conveying rollers 47.

The scanner 300 includes a contact glass 32, a first and second carriers 33 and 34, an imaging lens 35, and a reading sensor 36. The ADF 400 includes a document table 30.

The intermediate transfer belt 10, which is an intermediate transfer member serving as an image carrying member and forms a first transfer device, is provided at the center of the copier body 100. The intermediate transfer belt 10 is stretched over the first to third supporting rollers 14, 15, and 16 that serve as supporting rotary members, and is rotated in the clockwise direction in the drawing. On the left side of the second supporting roller 15 in the drawing, the intermediate transfer belt cleaning device 17 is provided to remove residual toner remaining on the intermediate transfer belt 10 after an image transfer operation.

Further, a portion of the intermediate transfer belt 10 stretched between the first and second supporting rollers 14 and 15 faces the tandem-type image forming unit 20. The tandem-type image forming unit 20 includes the image forming units 18Y, 18M, 18C, and 18K for respective colors of yellow (Y), magenta (M), cyan (C), and black (K) arranged in the moving direction of the intermediate transfer belt 10. In the present embodiment, the second supporting roller 15 serves as a drive roller. Further, the exposure device 21 that serves as a latent image forming device is provided above the tandem-type image forming unit 20.

Meanwhile, on the lower side of the tandem-type image forming unit 20 across the intermediate transfer belt 10, the second transfer device 22 that serves as a second transfer device is provided. In the second transfer device 22, the second transfer belt 24 that serves as a recording medium conveying member is stretched over the rollers 23. The second transfer belt 24 is pressed against the third supporting roller 16 via the intermediate transfer belt 10. The second transfer device 22 transfers an image formed on the intermediate transfer belt 10 onto a sheet, i.e., a recording medium.

On the left side of the second transfer device 22 in the drawing, the fixing device 25 is provided to fix the image transferred onto the sheet. The fixing device 25 is configured such that the pressure roller 27 is pressed against the fixing belt 26. The second transfer device 22 also has a recording medium conveying function of conveying the sheet transferred with the image to the fixing device 25. The second transfer device 22 may, as a matter of course, include a transfer roller and a non-contact charger. In such a case, however, it is difficult to provide the second transfer device 22 with the recording medium conveying function. The copier of the present embodiment also includes the sheet reversing device 28 below the second transfer device 22 and the fixing device 25. The sheet reversing device 28 extends parallel to the tandem-type image forming unit 20 to reverse the sheet to be recorded with images on both sides thereof.

To make a copy by using the above-described copier, a document is set on the document table 30 of the ADF 400. Alternatively, the ADF 400 is opened to set a document on the contact glass 32 of the scanner 300, and then the ADF 400 is closed to hold the document.

Thereafter, a start switch, not shown, is pressed. If the document has been set in the ADF 400, the document is conveyed onto the contact glass 32. Meanwhile, if the document has been set on the contact glass 32, the scanner 300 is immediately driven. Then, the first and second carriers 33 and 34 start moving.

Then, the first carrier 33 emits light from a light source. The light is reflected by a surface of the document, and is further reflected and directed to the second carrier 34. The light is then reflected by mirrors of the second carrier 34 and received by the reading sensor 36 through the imaging lens 35. Thereby, the image on the document is read.

In parallel with the document reading operation, a drive motor (not illustrated in FIG. 1, see FIG. 2) which serves as a drive source drives to rotate the second supporting roller (hereinafter referred to as the drive roller) 15. Thereby, the intermediate transfer belt 10 is moved in the clockwise direction in the drawing. Further, along with the movement of the intermediate transfer belt 10, the other two supporting rollers (hereinafter referred to as the driven rollers) 14 and 16 are driven to rotate.

At the same time, the respective photoconductor drums 40Y, 40M, 40C, and 40K, which are photoconductive members serving as latent image carrying members, are rotated in the image forming units 18Y, 18M, 18C, and 18K, respectively. The thus rotated photoconductor drums 40Y, 40M, 40C, and 40K are then subjected to an exposure process and a development process with the use of color information of yellow, magenta, cyan, and black. Thereby, single-color toner images (i.e., visible images) are formed on the photoconductor drums 40Y, 40M, 40C, and 40K.

Then, the respective toner images formed on the photoconductor drums 40Y, 40M, 40C, and 40K are sequentially transferred onto the intermediate transfer belt 10 such that the toner images are superimposed on one another. Thereby, a composite color image is formed on the intermediate transfer belt 10.

In parallel with the above-described image forming operation, one of the sheet feeding rollers 42 in the sheet feeding table 200 is selected and rotated to feed a sheet from the corresponding one of the sheet feeding cassettes 44 provided in the sheet bank 43. Then, the corresponding one of the separation rollers 45 separates the sheet from the other sheets to convey the sheet into the sheet feeding path 46. The sheet is then conveyed by the corresponding one of conveying rollers 47 into the sheet feeding path 48 in the copier body 100, and is hit and stopped by the registration roller 49.

Alternatively, the sheet feeding roller 50 is rotated to feed a sheet from the manual sheet feeding tray 51. The sheet is then separated from the other sheets by the separation roller 52, conveyed into the manual sheet feeding path 53, and hit and stopped by the registration roller 49 similarly as described above. Then, the registration roller 49 is rotated in appropriate timing with the composite color image carried on the intermediate transfer belt 10, and the sheet is conveyed into the space between the intermediate transfer belt 10 and the second transfer device 22. Then, the second transfer device 22 performs the transfer operation to transfer the color image onto the sheet.

The sheet transferred with the image is conveyed into the fixing device 25 by the second transfer belt 24. In the fixing device 25, the transferred image is fixed on the sheet by the heat and pressure applied thereto. Thereafter, the sheet is guided by the switching claw 55, discharged by the discharging roller 56, and stacked on the sheet discharging tray 57. Alternatively, the sheet is guided by the switching claw 55 and conveyed into the sheet reversing device 28 to be reversed. Then, the reversed sheet is guided again to the transfer position to be recorded with an image on the rear surface thereof. Thereafter, the sheet is discharged onto the sheet discharging tray 57 by discharging roller 56.

After the image transfer operation, the intermediate transfer belt cleaning device 17 removes the residual toner remaining on the intermediate transfer belt 10. Thereby, the intermediate transfer belt 10 is prepared for the next image forming operation by the tandem-type image forming unit 20. The registration roller 49, which is generally grounded when in use, may be applied with a bias voltage to remove paper particles of the sheet.

The present copier can also be used to make a monochrome copy. In such a case, the intermediate transfer belt 10 is separated from the photoconductor drums 40Y, 40M, and 40C by a not-illustrated device, and the photoconductor drums 40Y, 40M, and 40C are temporarily stopped from being driven. Thus, the image forming operation and the transfer operation are performed solely with the photoconductor drum 40K for the black color brought into contact with the intermediate transfer belt 10.

Subsequently, a description will be given of the drive control of the intermediate transfer belt 10, which is a characteristic feature of the present invention.

In the copier of the present embodiment, it is necessary to move the intermediate transfer belt 10 at a constant speed. In fact, however, the belt moving speed varies with the belt thickness. If the belt moving speed of the intermediate transfer belt 10 varies, the position to which the intermediate transfer belt 10 is actually moved does not match the target position to which the intermediate transfer belt 10 is intended to be moved. As a result, the toner images transferred from the photoconductor drums 40Y, 40M, 40C, and 40K onto the intermediate transfer belt 10 have different leading edge positions, and the color shift occurs.

Further, a toner image portion transferred onto the intermediate transfer belt 10 at a relatively high belt moving speed has a shape expanded in the circumferential direction of the intermediate transfer belt 10, as compared with the original shape of the toner image portion. Conversely, a toner image portion transferred onto the intermediate transfer belt 10 at a relatively low belt moving speed has a shape contracted in the circumferential direction of the intermediate transfer belt 10, as compared with the original shape of the toner image portion. In this case, the final image formed on the sheet has a periodical change in image density (i.e., banding) in a direction corresponding to the circumferential direction of the intermediate transfer belt 10.

In view of the above, the present embodiment is configured to maintain a constant moving speed of the intermediate transfer belt 10 with relatively high accuracy.

A description will now be given of a configuration and an operation for maintaining the constant moving speed of the intermediate transfer belt 10 with relatively high accuracy. The following description applies not only to the intermediate transfer belt 10 but also to belts in general subjected to drive control.

Figure 2:
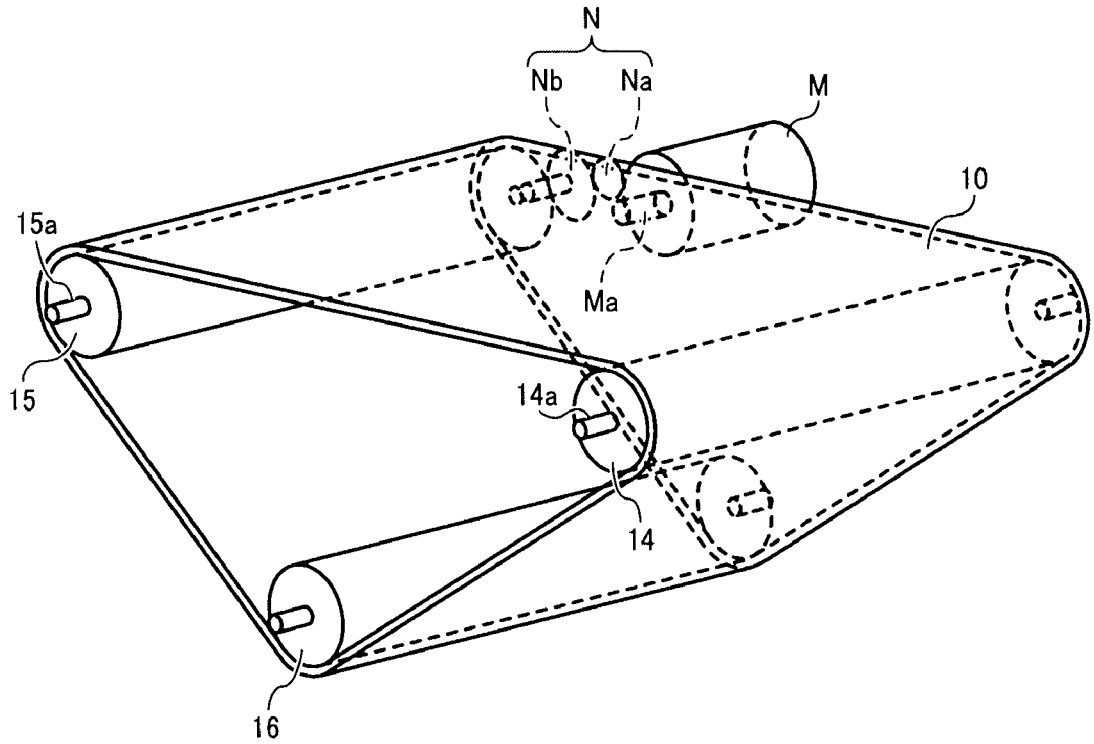
FIG. 2 is a schematic perspective view illustrating main components located near an intermediate transfer belt of FIG. 1.

FIG. 2 illustrates a configuration of main components located near the intermediate transfer belt 10. A shaft 15*a* of the drive roller 15 is connected to a drive gear N constituted by reduction gears Nb and Na meshing with a gear provided to a rotary shaft Ma of a transfer drive motor M. As the transfer drive motor M is driven to rotate, the shaft 15*a* of the drive roller 15 is rotated in proportion to the drive speed of the transfer drive motor M. Along with the rotation of the transfer drive motor M, the intermediate transfer belt 10 is driven to rotate the driven roller 14. In the present embodiment, a shaft 14*a* of the driven roller 14 is provided with an encoder (not illustrated in FIG. 2, see FIG. 5) which detects the rotational speed of the driven roller 14 for the speed control of the transfer drive motor M.

Further, in the present embodiment, the target rotational speed of the drive roller 15 is previously set. Further, PLL (Phase Locked Loop) control is performed for speed control such that the rotational speed actually detected by the encoder becomes equal to the target rotational speed. In the PLL control, a control gain is multiplied to improve the tracking ability of the control in response to the variation in the detected speed.

With the above-described control, variation in the moving speed of the intermediate transfer belt 10 that is extended by or spanned around the supporting rollers 14, 15, and 16, as shown in FIG. 2, can be minimized. As a result, the occurrence of the color shift is suppressed.

In the PLL control using the encoder, however, the control gain is multiplied to control the drive speed of the transfer drive motor M, as described above. Therefore, if a detection error occurs due to the variation in belt thickness, the transfer drive motor M is driven with the amplified error. That is, the moving speed of the intermediate transfer belt 10 varies in accordance with the belt thickness variation, and the color shift occurs.

Figure 3:
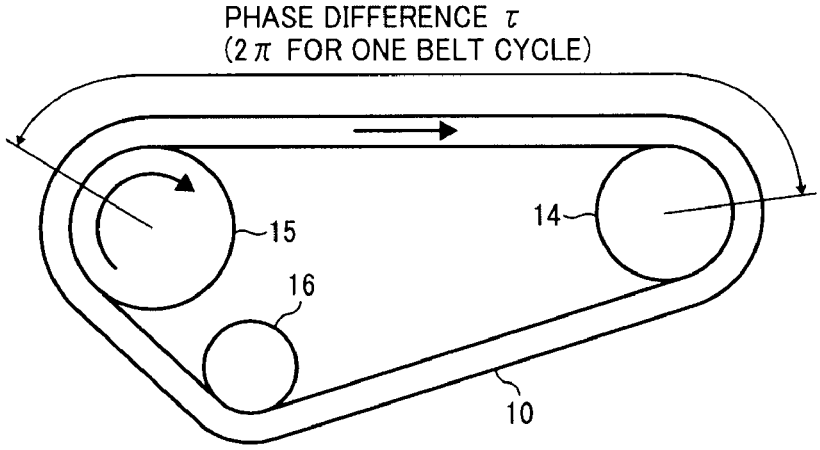
FIG. 3 is a diagram illustrating a configuration example of a belt conveying system.

With reference to FIG. 3, the mechanism of occurrence of the color shift will be described in detail.

In a state in which the transfer drive motor M is driven at a constant speed and the intermediate transfer belt 10 is ideally conveyed without variation in the moving speed thereof, if a thickened portion of the intermediate transfer belt 10 is wound around the driven roller 14, the effective radius of the driven roller 14 including the thickness of the intermediate transfer belt 10 stretched thereover is increased. As a result, the rotational angular displacement amount per predetermined time of the driven roller 14 is reduced. The reduction in the rotational angular displacement amount is detected as a reduction in the belt conveying speed. Meanwhile, if a thinned portion of the intermediate transfer belt 10 is wound around the driven roller 14, the rotational angular displacement amount per predetermined time of the driven roller 14 is increased. The increase in the rotational angular displacement amount is detected as an increase in the belt conveying speed.

For clearer understanding, a description will now be given of a case in which the angular velocity of the drive roller 15 is varied and the belt speed is kept constant, with reference to a graph shown in FIG. 4.

Figure 4:
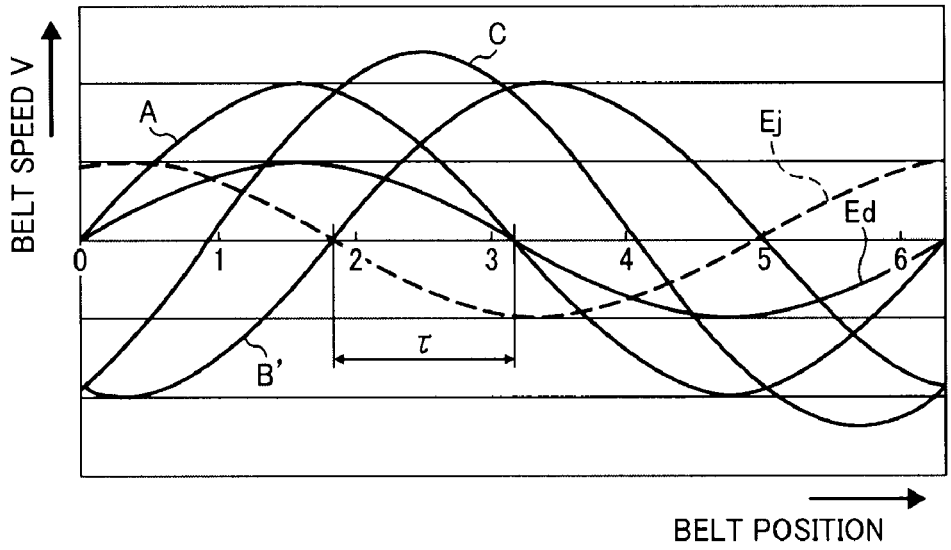
FIG. 4 is graphs illustrating the relationship between variations in thickness of the belt and variations in speed of a roller shaft.

In the graph of FIG. 4, a line A represents the conveying speed of the intermediate transfer belt 10 obtained when the drive roller 15 is rotated at a constant rotational angular velocity. A line C represents the rotational angular velocity of the driven roller 14 obtained when the drive roller 15 is rotated at a constant rotational angular velocity. A line B' represents the rotational angular velocity of the driven roller 14 obtained when the intermediate transfer belt 10 is rotated at a constant conveying speed. A line Ej represents the effective thickness variation of the intermediate transfer belt 10 at the driven roller 14 in FIG. 3. A line Ed represents the effective thickness variation of the intermediate transfer belt 10 at the drive roller 15 in FIG. 3.

As observed in FIG. 4, the line C, which represents the rotational angular velocity of the driven roller 14 obtained when the drive roller 15 is rotated at a constant rotational angular velocity, is formed by the superimposition of the line B', which represents the rotational angular velocity of the driven roller 14 obtained when the intermediate transfer belt 10 is rotated at a constant conveying speed, and the line A, which represents the conveying speed of the intermediate transfer belt 10 obtained when the drive roller 15 is rotated at a constant rotational angular velocity.

When the conveying speed of the intermediate transfer belt 10 is assumed to be constant, the waveform of the rotational angular velocity of the driven roller 14 is shifted in phase from the waveform of the line A in FIG. 4 by $\pi$. In this case, the rotational angular velocity of the driven roller 14 is represented by the waveform of the line B' in FIG. 4. The difference between the rotational angular velocity of the driven roller 14 (i.e., the waveform of the line B') and the rotational angular velocity of the drive roller 15 (i.e., a waveform shifted from the waveform of the line A by $\pi$) is represented by the waveform of the line C in FIG. 4 (i.e., the rotational angular velocity of the driven roller 14 obtained when the drive roller 15 is rotated at a constant rotational angular velocity).

For clearer understanding, the conveying speed of the intermediate transfer belt 10 is assumed to be constant in the above description. As described above, if the rotational angular velocity of the driven roller 14 is subtracted from the rotational angular velocity of the drive roller 15, the waveform of the line C in FIG. 4 (i.e., the rotational angular velocity of the driven roller 14 obtained when the drive roller 15 is rotated at a constant rotational angular velocity) is obtained.

That is, even when the rotational angular velocity of the drive roller 15 varies, a variation component attributed to the belt thickness variation can be obtained similarly as when the drive roller 15 is rotated at a constant rotational angular velocity, if the rotational angular velocity of the drive roller 15 is subtracted from the rotational angular velocity of the driven roller 14.

On the basis of the data of the variation in the rotational angular velocity (i.e., angular displacement) of the driven roller 14 and the rotational angular velocity (i.e., angular displacement) of the drive roller 15 measured as described above, the variation in the rotational angular velocity (i.e., angular displacement) of the driven roller 14 due to the belt thickness variation is calculated. Then, on the basis of the thus-calculated data, the target control value of the driven roller 14 for maintaining a constant conveying speed of the intermediate transfer belt 10 is set. The target value is then compared with the output value of the rotary encoder provided to the driven roller 14, and the drive control is performed.

The above-described method does not measure the actual micrometer-scale thickness of the intermediate transfer belt 10 to set the measured thickness as the control parameter. Instead, the method sets the control parameter to be an error in the angular displacement in radian units detected by the encoder, which is caused by variation in the belt thickness.

As described above, the control parameter is generated on the basis of the output results from the drive roller 15 and the encoder. Therefore, the control parameter can be generated by an actual image forming apparatus, for example. Thus, a measurement device for measuring the belt thickness is unnecessary. Accordingly, it is possible to configure the image forming apparatus at a relatively low cost.

The actual output result of the encoder is includes not only with the angular displacement detection error according to the belt thickness but also variation and rotation eccentricity components of the drive roller 15 and other constituent members. Therefore, a process of extracting only the component influenced by the driven roller 14 from the variety of components is performed, and the extraction result is set as the control parameter for controlling the angular displacement detection error.

Figure 5:
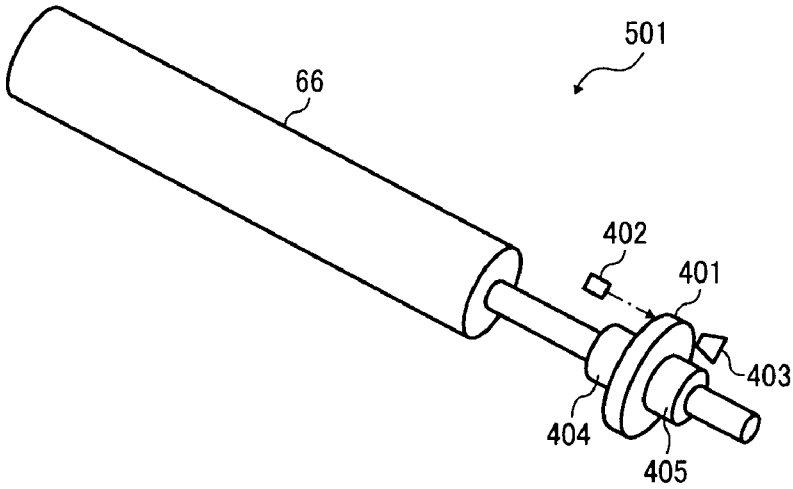
FIG. 5 is a detailed perspective view of essential parts of an encoder.

FIG. 5 illustrates a detailed view of the encoder. The encoder 501 is configured to include a disc 401, a light emitting device 402, a light receiving device 403, press bushings 404 and 405, and an encoder roller 66. The disc 401 is fixed by the press bushings 404 and 405 pressed onto a shaft of the encoder roller 66 in contact with the driven roller 14, and is rotated simultaneously with the rotation of the driven roller 14. Further, the disc 401 includes slits which transmit light with a resolution of a few hundred units in the circumferential direction of the disc 401. The light emitting device 402 and the light receiving device 403 are provided on the opposite sides of the disc 401. With this configuration, pulse-like ON and OFF signals are obtained in accordance with the rotation amount of the driven roller 14. With the use of the pulse-like ON and OFF signals, the movement angle (hereinafter referred to as the angular displacement) of the driven roller 14 is detected, and the drive amount of the transfer drive motor M is controlled.

Figure 6:
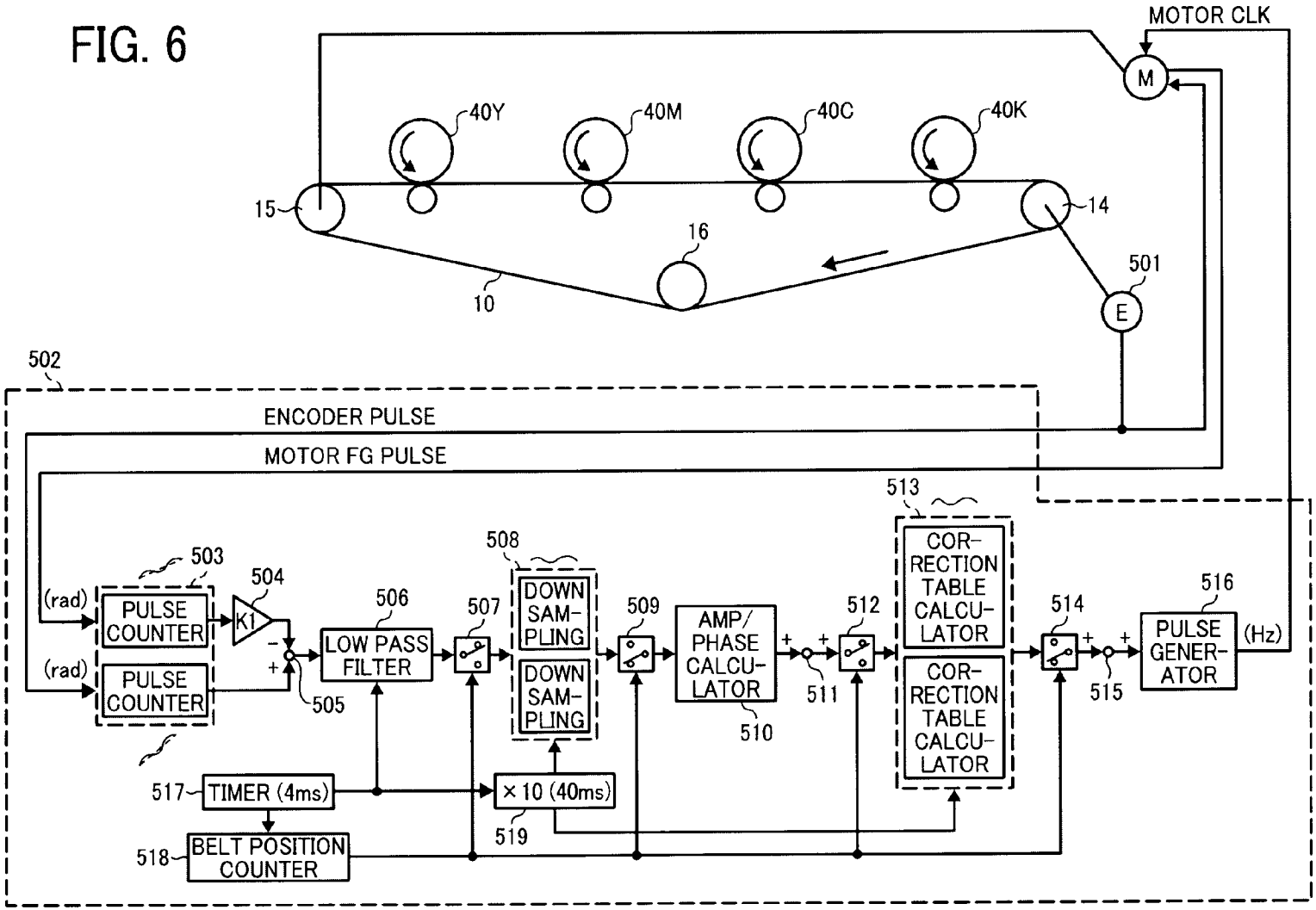
FIG. 6 is a block diagram illustrating a control configuration in an embodiment of the present invention for performing transfer belt feedback control and belt thickness variation correction control.

FIG. 6 is a block diagram of a drive control device of the copier according to the present embodiment. In FIG. 6, an angular displacement signal of the transfer drive motor M and an angular displacement detection signal of the encoder 501 are input to a control unit 502. In the present embodiment, a DC (Direct Current) brushless motor is used as the transfer drive motor M. Further, an FG (Frequency Generator) signal representing the detected rotational speed of a rotor of the transfer drive motor M is used as the angular displacement signal of the transfer drive motor M. The angular displacement signal of the transfer drive motor M, however, is not limited to the FG signal. Thus, a signal of an encoder attached to the shaft Ma of the transfer drive motor M may also be used.

The control unit 502 is configured to mainly include a pulse counter 503, a subtractor 505, a low-pass filter 506, a data downsampling memory 508, an amplitude and phase calculator 510, a correction table calculator 513, and a pulse generator 516. The control unit 502 also include a multiplier 504, switches 507, 509, 512, and 514, adders 511 and 515, a 4-millisecond timer 517, a belt position counter 518, and a synchronization timer 519. The switches 507, 509, 512, and 514 operate in accordance with the count position output by the belt position counter 518, and select the correction direction.

The pulse counter 503 counts the number of pulses of the angular displacement signal output by the transfer drive motor M (i.e., motor FG pulses) and the number of pulses of the angular displacement detection signal output by the encoder 501 (i.e., encoder pulses). The subtractor 505 calculates the difference between the pulse counts. The low-pass filter 506 removes high-frequency noise. The data downsampling memory 508 downsamples the subtraction result obtained through the process by the low-pass filter 506, and primarily stores the downsampling result for one belt cycle. The amplitude and phase calculator 510 extracts only the belt thickness variation component from the downsampling result for one belt cycle. The correction table calculator 513 calculates a correction value on the basis of the calculated amplitude and phase, and develops a correction table. The pulse generator 516 reads the correction value from the correction table and generates a pulse signal to be supplied to the transfer drive motor M.

The pulse counter 503 performs the process of counting the number of pulses of the angular displacement signal output by the transfer drive motor M and the number of pulses of the angular displacement detection signal output by the encoder 501. The pulse counting process is performed to physically detect edges of the pulses and measure the number of inputs of the edges. In this case, the transfer drive motor M and the encoder 501 have different resolutions. Therefore, the multiplier 504 multiplies the respective pulse counts by a constant for the adjustment of the resolution.

Thereafter, the subtractor 505 calculates the difference between the counting results. In the present embodiment, the control unit 502 includes the 4-millisecond timer 517. Thus, each of the pulse counts is referred to at the timing of the 4-millisecond timer 517. The subtraction result is stored in a memory of the low-pass filter 506 on a 4-millisecond cycle.

As can be appreciated by those skilled in the art, if high-speed sampling can be performed, the quantization error is reduced. Therefore, the timing of calculating the difference, which is set to be every four milliseconds in the present embodiment, is not limited thereto. The timing of calculating the difference is determined on the basis of the capacity available in the internal memory and the pulse generation cycle determined by the FG signal of the transfer drive motor M, the resolution of the encoder 501, and the moving speed of the intermediate transfer belt 10.

Each of the outputs includes a roller rotation cycle variation component, a drive gear cycle variation component, and a belt cycle variation component according to the belt thickness variation. Therefore, the low-pass filter 506 performs a moving average process to remove the cycle variation components other than the cycle variation component according to the belt thickness variation from the differences obtained by the sampling performed every four milliseconds. In the present embodiment, to remove the drive roller cycle variation component, which is relatively close to the belt cycle variation component, the moving average process is performed with the use of a memory capable of storing the differences for two cycles of the drive roller 15. This is because a calculation error occurs if a variation component close to the belt cycle variation component is superimposed on the data in the calculation of the amplitude and the phase described later. To eliminate the error, a process of removing the drive roller cycle variation component is previously performed.

The data subjected to the moving average process is downsampled every 40 milliseconds at the timing of the synchronization timer 519, and the data for one belt cycle is primarily stored in the data downsampling memory 508. In the moving average process, the sampling is performed on a relatively short cycle of four milliseconds to reduce the quantization error. Meanwhile, in the calculation of the amplitude and the phase, the amplitude and phase for one belt cycle are calculated. Thus, a large number of data items are unnecessary, as long as the data used in the calculation is not superimposed with the other variation components. Therefore, the present embodiment sets the data downsampling cycle to be 40 milliseconds, and performs the process of downsampling the moving average processed data on the 40-millisecond cycle and holding the thus downsampled data in the data downsampling memory 508.

In the subsequent process at the amplitude and phase calculator 510, it is necessary for the calculation of the phase to manage a reference position set on the intermediate transfer belt 10. Thus, a reference mark is provided on the intermediate transfer belt 10, and the data is sampled while the reference position is detected by a sensor. Thereby, the management of the reference position can be performed. In the present embodiment, the pulse count is referred to at the timing of the 4-millisecond timer 517, and the timing of start the calculation of the difference is set to be a virtual reference position. Thereafter, the number of belt rotations and the reference position are detected on the basis of the count counted every four milliseconds.

After the data for one belt cycle is stored in the data downsampling memory 508, the amplitude and phase calculator 510 calculates the maximum amplitude and the phase at the reference position, as described above. In the calculation of the amplitude and the phase, the amplitude and the phase of a high-order component of the cycle variation component of the intermediate transfer belt 10 can be calculated. In the present embodiment, the amplitudes and the phases of the first to third order components are calculated.

In the above-described calculation, the quadrature detection is performed. The basic concept of the quadrature detection will now be described.

In a waveform which periodically changes in the time domain, the fundamental frequency f0 and the fundamental angular frequency ω0 are represented as f0=1/T and ω0=2πf0, respectively, wherein T represents the cycle of the waveform. Further, discrete data items can be represented as a Fourier series as in Formula 1.

$$x(t) = a_0 + a_1^{\cos}\omega_0^t + \ldots + a_n^{cosn}\omega_0^t + b_1^{sin}\omega_0^t + \ldots + b_n^{sinn}\omega_0^t \quad (1)$$

$$= a_0 + \sum_{n=1}^{\infty}(a_n^{cosn}\omega_0^t + b_n^{sinn}\omega_n^t)$$

$$(n = 1, 2, 3 \ldots \infty)$$

Herein, the respective components can be calculated from Formula 2.

$$a_0 = \frac{1}{T}\int_0^T x(t)dt \quad (2)$$

$$a_n = \frac{2}{T}\int_0^T x(t)\cos n\omega_0 t dt$$

$$b_n = \frac{2}{T}\int_0^T x(t)\sin n\omega_0 t dt$$

In Formula 2, $a_0$ represents a direct current component, and $a_n$ and $b_n$ represent the amplitude of the cosine wave and the amplitude of the sine wave, respectively, obtained at an angular frequency of nω0.

As a result, Formula 3 can be derived, wherein $r_n$ and $\phi_n$ represent the amplitude and the phase, respectively, of the n-th order harmonic.

$$x(t) = \sum_{n=1}^{\infty} r_n\cos(n\omega_0 t - \phi_n) \quad (3)$$

$$r_n = \sqrt{a_n^2 + b_n^2}$$

$$\phi_n = \tan^{-1}\frac{b_n}{a_n}$$

In the calculation of the amplitude and the phase, the sine and cosine are calculated for the discrete data items downsampled and stored in the data downsampling memory 508, with the use of Formula 2 and on the basis of the frequency f for one cycle of the intermediate transfer belt 10 obtained in the measurement process and the data sampling time t for sampling each of the discrete data items. Then, on the basis of the accumulated calculation results, the amplitudes $a_n$ and $b_n$ are calculated. Thereafter, the amplitude $r_n$ and the phase $\phi_n$ are calculated by the use of Formula 3.

The calculation results obtained by the above-described calculation are superimposed with the detection error at the drive roller 15 and the detection error at the driven roller 14. Therefore, the amplitude is corrected by the use of a conversion coefficient uniquely determined by the mechanical layout of the transfer unit (i.e., the second transfer device 22), and the correction value for correcting the detection error at the driven roller 14 is calculated. Then, the amplitude and the phase are calculated for the first to third order components of the detection error component detected at the driven roller 14. Thereafter, a composite wave of the respective components is calculated by the use of a sine function, and a correction table for one belt cycle is calculated by the correction table calculator 513.

After the calculation of the correction table by the correction table calculator 513, the pulse generator 516 generates the pulse signal to be output to the transfer drive motor M. In this process, the correction value is read from the correction table, while the reference address is switched between memories (i.e., first and second holding devices) in accordance with the position to which the intermediate transfer belt 10 is moved. The value calculated by the correction table calculator 513 corresponds to the difference between the pulse count of the FG signal output by the transfer drive motor M and the pulse count of the signal output by the encoder 501, which are referred to on the 4-millisecond cycle. Therefore, the difference is converted into the frequency and added to the original reference frequency to determine the frequency to be supplied to the transfer drive motor M. Then, a cycle pulse signal is generated on the basis of the thus determined frequency to generate the pulse signal to be supplied to the transfer drive motor M.

With the above-described operation repeated at every belt cycle, the detection error occurring at the driven roller 14 due to the belt thickness variation is extracted from the FG signal of the transfer drive motor M and the output of the encoder 501. Then, the detection error is converted into the target frequency to be controlled. As a result, the PLL control of the DC motor (i.e., the transfer drive motor M) is performed, and the intermediate transfer belt 10 can be operated at a constant speed.

Figure 7:
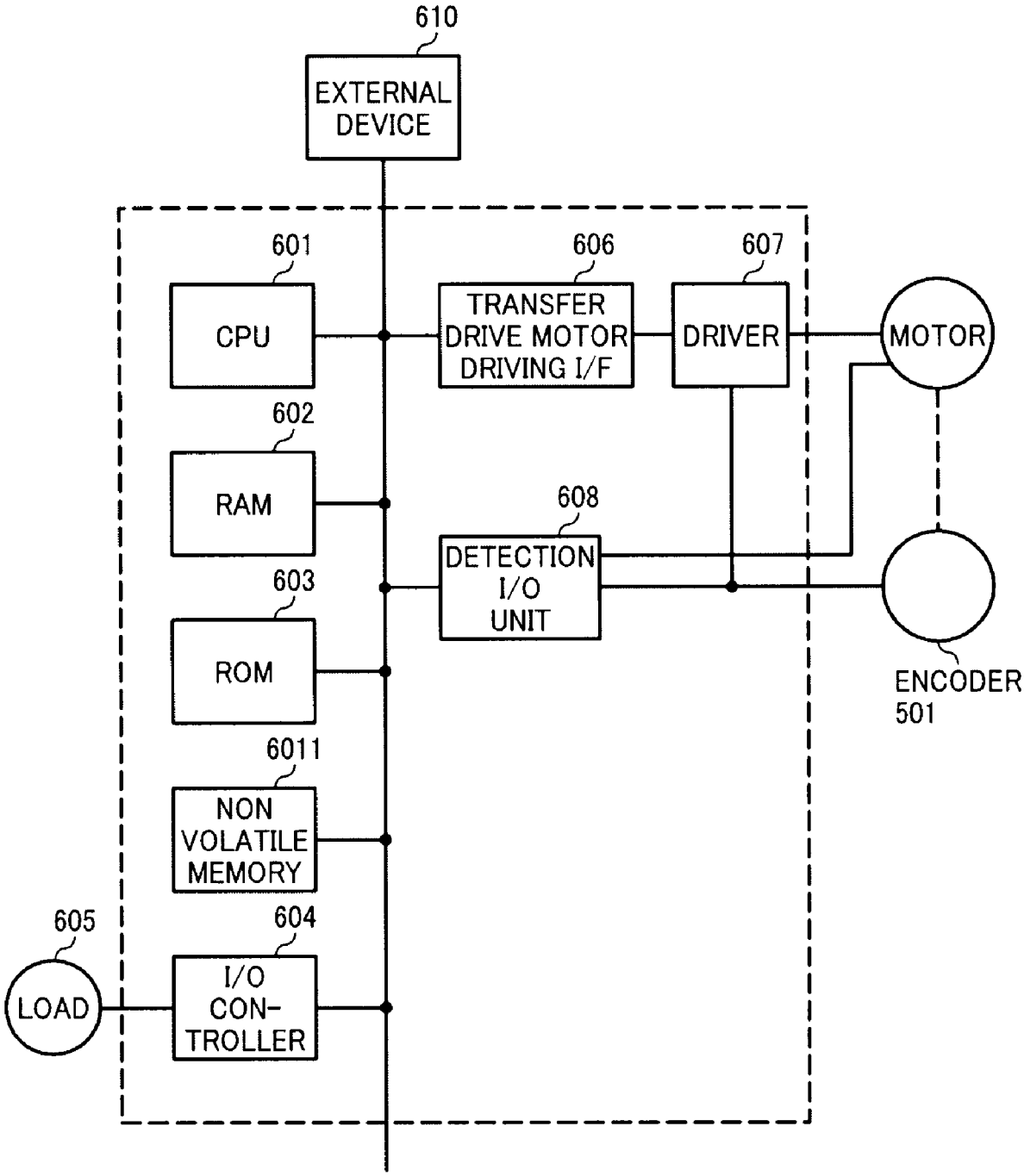
FIG. 7 is a block diagram illustrating a hardware configuration of a transfer drive motor control system of the embodiment and a device to be controlled.

FIG. 7 is a block diagram illustrating a hardware configuration of a control system of the transfer drive motor M of the present embodiment and a device to be controlled. On the basis of the output signal of the encoder 501, the control system digitally controls a drive pulse which drives the transfer drive motor M. The control system is configured to include a CPU (Central Processing Unit) 601, a RAM (Random Access Memory) 602, a ROM (Read-Only Memory) 603, a nonvolatile memory 611, an IO (Input-Output) controller 604, a transfer drive motor driving I/F (Interface) 606, a driver 607, a detection IO unit 608, and a bus 609.

The CPU 601 performs overall control of the image forming apparatus of the present embodiment, such as control of the reception of image data input by an external device 610 and control of the transmission and reception of control commands. The RAM 602 used as a working area, the ROM 603 for storing a program, and the IO controller 604 are connected to one another via the bus 609, and perform, in accordance with commands from the CPU 601, a variety of operations, such as data reading and writing, and the operations of a motor, a clutch, a solenoid, a sensor, and so forth for driving each load.

In accordance with a drive command from the CPU 601, the transfer drive motor driving IF 606 outputs a command signal for commanding the driver 607 to set the drive frequency of the drive pulse signal. In accordance with the drive frequency, the driver 607 performs the PLL control, and the transfer drive motor M is driven to rotate.

The output of the encoder 501 and the FG signal of the transfer drive motor M are input to the detection IO unit 608. The detection IO unit 608 processes the output pulses of the encoder 501 and the output pulses of the FG signal of the transfer drive motor M, and converts the output pulses into digital values. The detection IO unit 608 includes a counter for counting the output pulses. The value counted by the counter is transmitted to the CPU 601 via the bus 609.

On the basis of the command signal transmitted from the CPU 601 to set the drive frequency, the transfer drive motor driving IF 606 generates a pulse-like control signal.

The driver 607 is configured to include a PLL control IC (Integrated Circuit), a power semiconductor device (e.g., a transistor), and so forth. On the basis of the pulse-like control signal output by the transfer drive motor driving IF 606 and the rotation information of the driven roller 14 (i.e., the shaft 14*a*) output by the encoder 501, the driver 607 performs the PLL control such that the rotational angular velocity of the driven roller 14 (i.e., the shaft 14*a*) becomes equal to the control signal in phase and speed. Further, in accordance with the pulse frequency generated by the PLL control, the driver 607 applies a phase signal to the transfer drive motor M. As a result, the driven roller 14 (i.e., the shaft 14*a*) is drive-controlled with the predetermined drive frequency output by the CPU 601. Accordingly, tracking control is performed such that the angular displacement of the disc 401 tracks the target angular displacement. As a result, the driven roller 14 (i.e., the shaft 14*a*) is rotated at a predetermined constant angular velocity. The angular displacement of the disc 401 is detected by the encoder 501 and the detection IO unit 608 and input to the CPU 601 to repeat the control operation.

The RAM 602, which is used as the working area in the execution of a program stored in the ROM 603, is also used as a data storage area used by the low-pass filter 506 for removing the noise component from the difference between the output of the encoder 501 and the FG signal of the transfer drive motor M as described above, as a storage area of the downsampled data, and as a storage area of the correction value. The RAM 602 is a volatile memory. Thus, the parameters used in the next activation of the intermediate transfer belt 10, such as the amplitude and the phase, are stored in the nonvolatile memory 611, which is an EEPROM (Electrically Erasable Programmable Read-Only Memory) or the like. Then, upon turn-ON of the power supply or activation of the transfer drive motor M, the data for one cycle of the intermediate transfer belt 10 is extracted into the RAM 602 by the use of a sine function or an approximate equation.

The actual thickness of the intermediate transfer belt 10, which is largely determined during the production process, can be represented by a sine-like waveform in most cases. Thus, it is not particularly necessary to hold all of the angular displacement detection error data for one cycle of the intermediate transfer belt 10. Therefore, if the amplitude and phase from the reference position are calculated in the measurement process, and if the angular displacement detection error data is calculated on the basis of the thus calculated data, the error data can suffice as equivalent data. Accordingly, it is unnecessary to store in the nonvolatile memory 611 the angular displacement detection error data for every control cycle. Therefore, the angular displacement detection error data due to the belt thickness variation can be generated solely with the use of the parameters of the amplitude and the phase. Accordingly, the control operation can be performed if an area for a volatile memory is prepared. The angular displacement detection error data due to the belt thickness variation is generated upon turn-ON of the power supply or activation of the transfer drive motor M.

A description will now be given of a storage device which holds the amplitude and the phase of the extracted alternating current component, and a device which determines normality or abnormality of the data before the amplitude and phase stored in the storage device are fed back to the drive supporting rotary member (i.e., the drive roller 15), and which uses substitution data if the abnormality of data is determined.

The amplitude varies in a certain range, depending on the characteristics of the intermediate transfer belt 10. Further, the phase varies in a range of from 0 degrees to 360 degrees. The amount of a possible shift occurring in one belt cycle is within a certain range. If the calculated data is out of the normal range, abnormal factors such as vibration, the discrepancy is conceivably due to noise mixed into the detection signal, and slipping of the encoder roller 66.

The respective normal ranges of the amplitude and the phase are set by the nonvolatile memory 611 such as an EEPROM. This setting can be performed, for example, during shipping inspection at a manufacturing facility and an operation using an operation panel of an operation section performed by a service technician who provides technical support. The normal ranges can be set in accordance with the characteristics of the individual belt, for example.

If the amplitude or phase obtained by the calculation of the sampled data is outside the normal range, and if the amplitude or phase is used in the feedback, the control performance may deteriorate.

Figure 8:
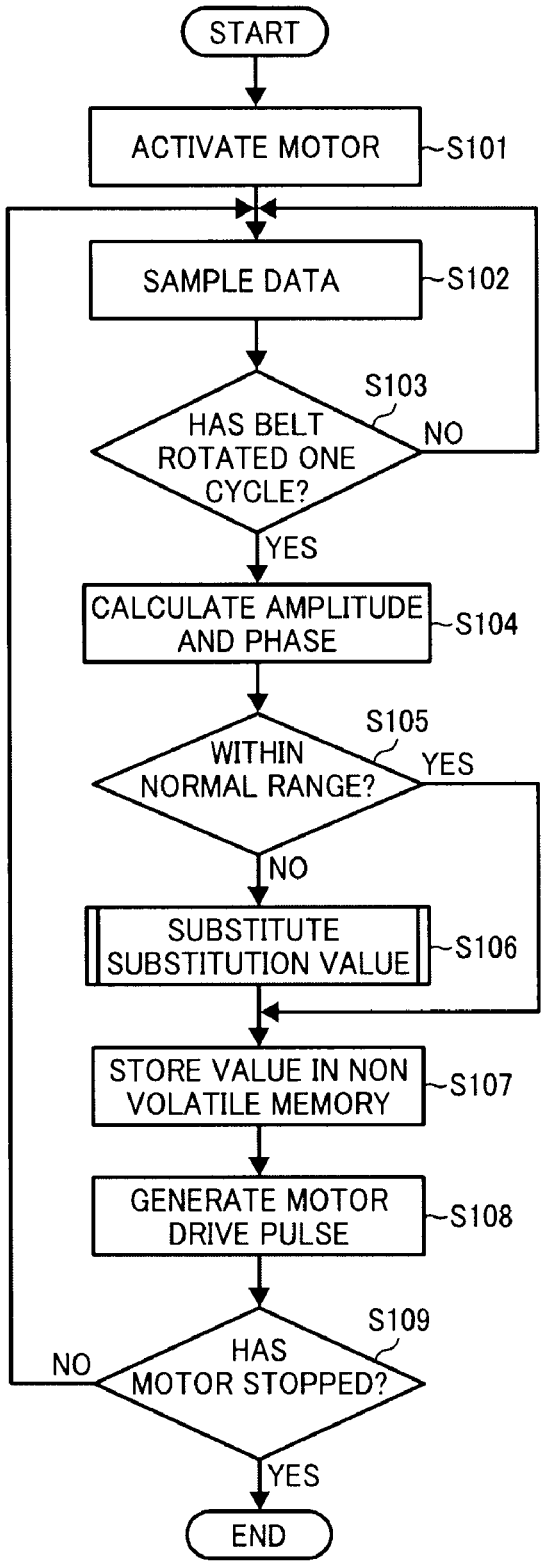
FIG. 8 is a flowchart illustrating a control procedure of a control operation performed with the use of a substitution value when an abnormal calculation result is obtained in the embodiment.

In view of the above, if an abnormal calculation result is obtained, a substitution value is substituted for the abnormal value. Thereby, the control performance can be improved as much as possible. FIG. 8 is a flowchart illustrating the procedure of a control operation using the substitution value.

In the drawing, upon activation of the transfer drive motor M (Step S101), data sampling is performed for one cycle of the intermediate transfer belt 10 (Steps S102 and S103). Then, upon completion of data sampling for one belt cycle, the amplitude and phase calculator 510 calculates the amplitude and the phase by using Formulae 2 and 3 (Step S104), and whether or not the calculated amplitude and phase are within the respective normal ranges is determined (Step S105). If any of the calculated amplitude and phase is out of the normal range (NO at Step S105), the substitution value is substituted for any of the calculated amplitude and phase (Step S106). Meanwhile, if the calculated amplitude and phase are within the respective normal ranges (YES at Step S105), the calculated values are directly stored in the nonvolatile memory 611 (Step S107).

Subsequently, the correction table calculator 513 reads the correction value from the correction table in the nonvolatile memory 611, and the pulse generator 516 generates the pulse signal to be supplied to the transfer drive motor M (Step S108). The above-described operation is repeated until the transfer drive motor M is stopped (Step S109). When the transfer drive motor M is stopped, the procedure is completed.

The substitution of the substitution value at the process of Step S106 is performed by such methods as the use of a past data value stored in a memory (hereinafter referred to as the first method), feedback using an amplitude of zero (hereinafter referred to as the second method), and feedback using an average value of a few past data values (hereinafter referred to as the third method).

Figure 9A:
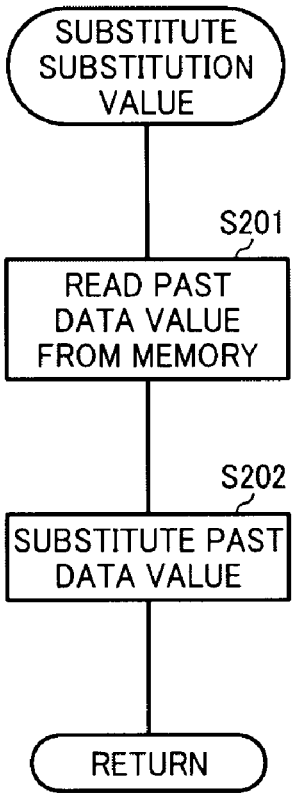
FIGS. 9A, 9B, and 9C are flowcharts each illustrating a subroutine process of the flowchart of FIG. 8, in which the substitution value is substituted for an abnormal value.

FIG. 9A is a flowchart illustrating the procedure of the process according to the first method. In this method, a past data value is read from the nonvolatile memory 611 (Step S201), and the thus-read past data value is substituted for the abnormal value (Step S202). The past data value may immediately precede the present data value, for example, or may precede the present data value by a few data values.

Figure 9B:
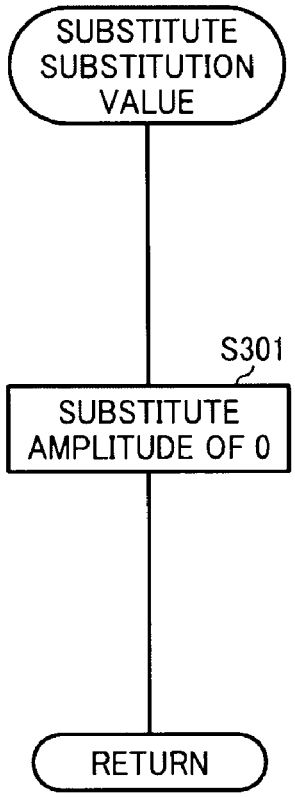

FIG. 9B is a flowchart illustrating the procedure of the process according to the second method. In the substitution according to this method, an amplitude of zero is used as the substitution value of the amplitude (Step S301). In this case, it is difficult to expect high control performance obtained by the use of the immediately preceding data value as in the first method. However, higher control performance can be expected than when the abnormal value is used in the feedback.

Figure 9C:
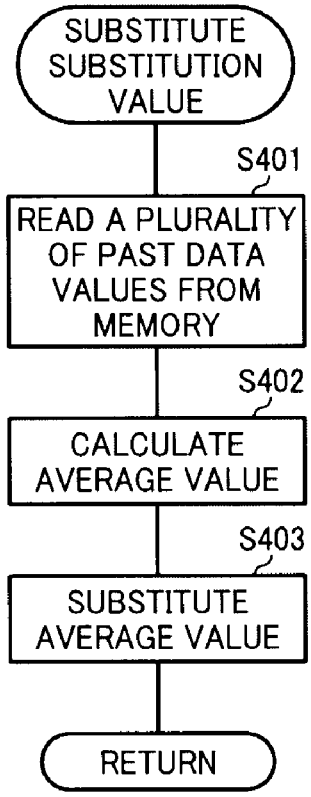

FIG. 9C is a flowchart illustrating the procedure of the process according to the third method. In this method, the average value of a few past data values is used. In this process, therefore, the few past data values are read from the nonvolatile memory 611 (Step S401), and the average value of the past data values is calculated (Step S402). Then, the average value is substituted for the abnormal value (Step S403), and the thus-substituted value is used. Also in this case, higher control performance can be expected than when the abnormal value is used in the feedback.

The above description has been given of the example of drive control of an intermediate transfer belt performed in a tandem-type image forming apparatus, as an embodiment of the present invention. The present invention can also be applied to drive control performed in a tandem-type image forming apparatus according to a direct transfer method, in which an image is directly transferred onto a recording sheet (i.e., a sheet-like recording medium) conveyed by a conveying belt. Further, the application of the prevent invention is not limited to the drive control performed in the image forming apparatuses according to the above-described methods. Thus, the present invention can also be applied to drive control performed in an image forming apparatus using a photoconductor belt. In such cases, similar effects as described above can be obtained.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape, are not limited the embodiments and thus may be preferably set. It is therefore to be understood that within the scope of the appended claims, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. A belt drive control device, comprising:

a first detection device to detect one of rotational angular displacement and rotational angular velocity of a driven supporting rotary member included in a plurality of supporting rotary members over which a circular belt is extended and not contributing to transmission of torque;

a second detection device to detect one of the rotational angular displacement and the rotational angular velocity of a drive supporting rotary member included in the plurality of supporting rotary members and receiving the torque from a drive source;

an extraction device to extract, from a difference between a detection result of the first detection device and a detection result of the second detection device, amplitude and phase of a belt alternating current component of one of a rotational angular displacement and a rotational angular velocity having a frequency corresponding to a cyclical variation in thickness of the belt;

a control device to control the driving of the belt by controlling the rotation of the drive supporting rotary member based on the amplitude and the phase of the belt alternating current component extracted by the extraction device;

a first holding device to hold the amplitude and the phase extracted by the extraction device:

a first feedback device to feed back the amplitude and the phase held by the first holding device to rotation control of the drive supporting rotary member;

a second holding device to set and hold respective normal ranges of the amplitude and the phase; and a second feedback device to perform, if any of the amplitude and the phase is out of the normal range thereof, a feedback operation using a substitution value substituted for the any of the amplitude and the phase fed back by the first feedback device, wherein if any of the amplitude and the phase is out of the normal range thereof, the second feedback device uses, as the substitution value, the average value of a plurality of past values of the any of the amplitude and the phase held by the first holding device.

2. A belt drive control device, comprising:

a first detection device to detect one of rotational angular displacement and rotational angular velocity of a driven supporting rotary member included in a plurality of supporting rotary members over which a circular belt is extended and not contributing to transmission of torque;

a second detection device to detect one of the rotational angular displacement and the rotational angular velocity of a drive supporting rotary member included in the plurality of supporting rotary members and receiving the torque from a drive source;

an extraction device to extract, from a difference between a detection result of the first detection device and a detection result of the second detection device, amplitude and phase of a belt alternating current component of one of a rotational angular displacement and a rotational angular velocity having a frequency corresponding to a cyclical variation in thickness of the belt;

a control device to control the driving of the belt by controlling the rotation of the drive supporting rotary member based on the amplitude and the phase of the belt alternating current component extracted by the extraction device;

a first holding device to hold the amplitude and the phase extracted by the extraction device:

a first feedback device to feed back the amplitude and the phase held by the first holding device to rotation control of the drive supporting rotary member;

a second holding device to set and hold respective normal ranges of the amplitude and the phase; and a second feedback device to perform, if any of the amplitude and the phase is out of the normal range thereof, a feedback operation using a substitution value substituted for the any of the amplitude and the phase fed back by the first feedback device, wherein if any of the amplitude and the phase is out of the normal range thereof, the second feedback device uses an amplitude of zero.

3. A belt drive control device, comprising:

a first detection device to detect one of rotational angular displacement and rotational angular velocity of a driven supporting rotary member included in a plurality of supporting rotary members over which a circular belt is extended and not contributing to transmission of torque;

a second detection device to detect one of the rotational angular displacement and the rotational angular velocity of a drive supporting rotary member included in the plurality of supporting rotary members and receiving the torque from a drive source;

an extraction device to extract, from a difference between a detection result of the first detection device and a detection result of the second detection device, amplitude and phase of a belt alternating current component of one of a rotational angular displacement and a rotational angular velocity having a frequency corresponding to a cyclical variation in thickness of the belt;

a control device to control the driving of the belt by controlling the rotation of the drive supporting rotary member based on the amplitude and the phase of the belt alternating current component extracted by the extraction device;

a first holding device to hold the amplitude and the phase extracted by the extraction device;

a first feedback device to feed back the amplitude and the phase held by the first holding device to rotation control of the drive supporting rotary member;

a second holding device to set and hold respective normal ranges of the amplitude and the phase; and a second feedback device to perform, if any of the amplitude and the phase is out of the normal range thereof, a feedback operation using a substitution value substituted for the any of the amplitude and the phase fed back by the first feedback device, wherein the second holding device stores externally input information of the respective normal ranges of the amplitude and the phase, and reads and sets the normal ranges.

4. A belt drive control device, comprising:

a first detection device to detect one of rotational angular displacement and rotational angular velocity of a driven supporting rotary member included in a plurality of supporting rotary members over which a circular belt is extended and not contributing to transmission of torque;

a second detection device to detect one of the rotational angular displacement and the rotational angular velocity of a drive supporting rotary member included in the plurality of supporting rotary members and receiving the torque from a drive source;

an extraction device to extract, from a difference between a detection result of the first detection device and a detection result of the second detection device, amplitude and phase of a belt alternating current component of one of a rotational angular displacement and a rotational angular velocity having a frequency corresponding to a cyclical variation in thickness of the belt;

a control device to control the driving of the belt by controlling the rotation of the drive supporting rotary member based on the amplitude and the phase of the belt alternating current component extracted by the extraction device;

a first holding device to hold the amplitude and the phase extracted by the extraction Device;

a first feedback device to feed back the amplitude and the phase held by the first holding device to rotation control of the drive supporting rotary member;

a second holding device to set and hold respective normal ranges of the amplitude and the phase; and a second feedback device to perform, if any of the amplitude and the phase is out of the normal range thereof, a feedback operation using a substitution value substituted for the any of the amplitude and the phase fed back by the first feedback device, wherein the first holding device stores and reads a value from another storage device which stores and reads externally input information and sets a predetermined value.

* * * * *